United States Patent [19]

Holbrook

[11] 4,041,630

[45] Aug. 16, 1977

[54] FRAME FOR EXHIBITING ALBUMS AND THE LIKE

[75] Inventor: R. Patrick Holbrook, San Francisco, Calif.

[73] Assignee: Album Frames Inc., San Francisco, Calif.

[21] Appl. No.: 691,534

[22] Filed: June 1, 1976

[51] Int. Cl.[2] ..... G09F 1/12

[52] U.S. Cl. ..... 40/152.1; 40/124.2; 40/16

[58] Field of Search ..... 40/152, 152.1, 124, 40/124.2, 124.4, 340, 125 H, 63 R, 64 R, 65, 16; 160/201, 135, 351; 211/40; 248/466, 498, 489

[56] References Cited

U.S. PATENT DOCUMENTS

| | | | |
|---|---|---|---|
| 2,521,411 | 9/1950 | Rosenberg | 40/152.1 |
| 3,017,999 | 1/1962 | Cano | 211/40 |

*Primary Examiner*—Louis G. Mancene

*Assistant Examiner*—Wenceslao J. Contreras

*Attorney, Agent, or Firm*—Phillips, Moore, Weissenberger, Lempio & Majestic

[57] ABSTRACT

A rectangular and open album frame comprises parallel upper and lower sections secured to parallel first and second side sections. Each of the upper, lower and first side sections has an elongated groove defined on an inner side thereof to further define generally C-shaped composite mounting grooves adapted to retain an album cover or the like therein. An elongated slot is formed through the second side section to extend substantially the full length thereof whereby the album cover may be inserted through the slot and disposed in the frame for display purposes. A clip-type hanger has a first leg which may be inserted upwardly into the groove defined in the upper section of the frame and a parallel and spaced second leg connected to the first leg and adapted to be secured to a wall or the like.

11 Claims, 7 Drawing Figures

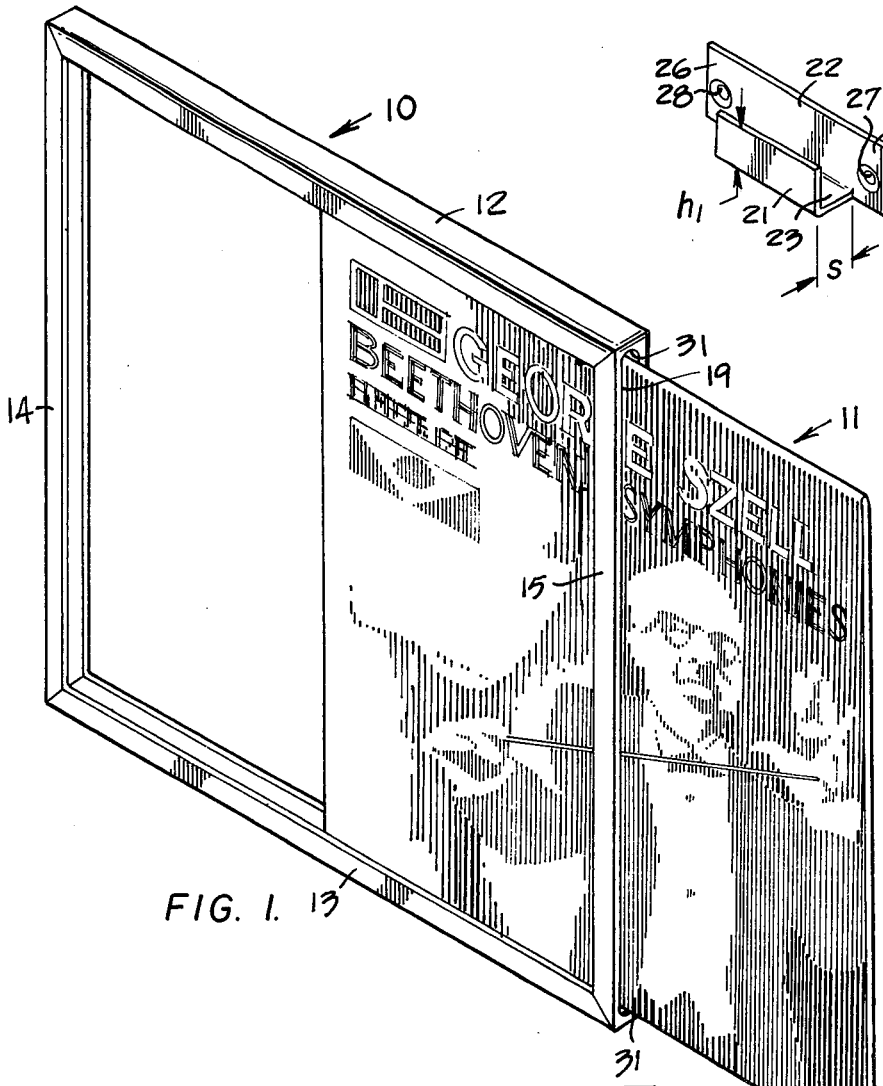
FIG. 1.
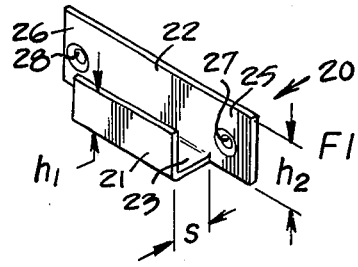
FIG. 5.
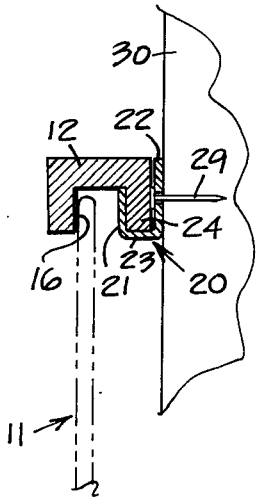
FIG. 6.
FIG. 2.
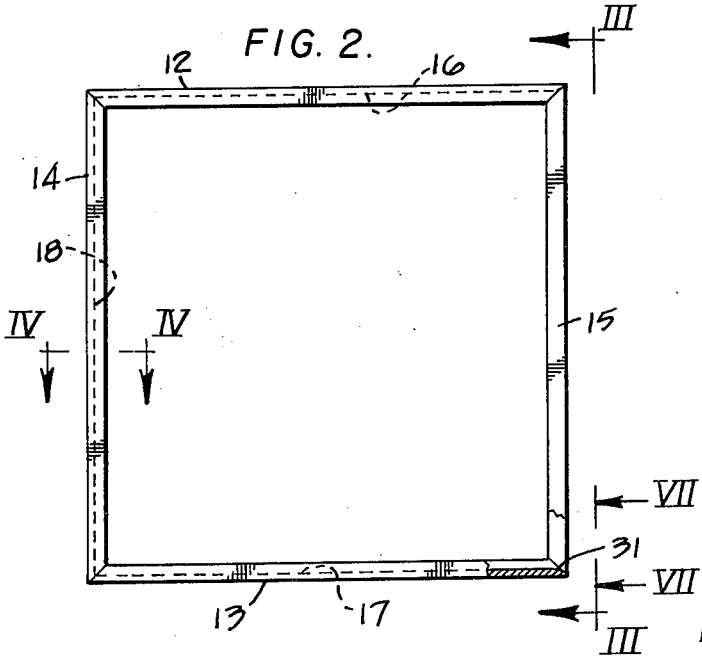
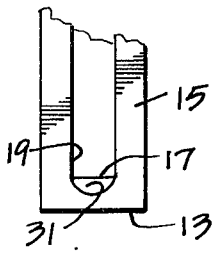
FIG. 7.
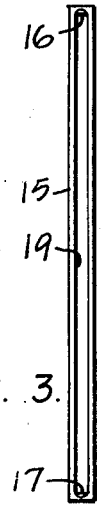
FIG. 3.
FIG. 4.
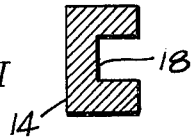

FRAME FOR EXHIBITING ALBUMS AND THE LIKE

BACKGROUND OF THE INVENTION

Record albums are normally retained in a rack in a record store whereby a customer may peruse the same by flipping the albums individually. Attempts to display the albums to incite the customer to purchase the same normally comprises securing the albums to a wall by conventional fastening means, such as tape, nails or the like. In addition to the difficulty of mounting the album, another album cannot be easily substituted therefor. Furthermore, the album cover is oftentimes defaced or otherwise damaged to render it unsalable. Similar display problems are encountered by the customer when he places the record album in use at home.

SUMMARY OF THIS INVENTION

An object of this invention is to provide an economical and non-complex open album frame adapted to have a record album inserted therein and removed therefrom expeditiously. The frame is rectangular and comprises upper and lower sections disposed in parallel relationship and a first side section secured between first ends of the upper and lower sections. An elongated groove is defined on an inner side of each of the upper, lower and first side sections with the grooves defined in the upper and lower sections intersecting opposite ends of the groove defined in the first side section to further define generally C-shaped composite mounting grooves for the album.

A second side section, disposed in parallel relationship relative to the first side section, is secured between second ends of the upper and lower sections. An elongated slot is formed through the second side section to extend substantially the full length thereof and intersects the grooves defined in the upper and lower sections. Thus, an album may be inserted through the slot and slid into the C-shaped composite mounting grooves defined in the frame to display the album.

BRIEF DESCRIPTION OF THE DRAWINGS

Other objects of this invention will become apparent from the following description and accompanying drawings wherein:

FIG. 1 is an isometric view schematically illustrating an album frame embodying this invention with a record album being partially inserted therein;

FIG. 2 is a reduced plan view of the album frame;

FIG. 3 is an end elevational view of the album frame, taken in the direction of arrows III—III in FIG. 2;

FIG. 4 is an enlarged cross sectional view of one of the sections of the album frame, taken in the direction of arrows IV—IV in FIG. 1;

FIG. 5 is an enlarged isometric view of a hanger, employed to mount the album frame on a wall;

FIG. 6 is a sectional view illustrating the album frame mounted on a wall by the hanger; and FIG. 7 is an enlarged view, taken in the direction of arrows VII—VII in FIG. 2.

DETAILED DESCRIPTION

FIG. 1 illustrates an open album frame 10 adapted to have at least one record album 11 inserted therein for display purposes. The album frame comprises an upper section 12 and a lower section 13 disposed in parallel relationship relative to the upper section. A first side section 14 is secured between first ends of the upper and lower sections with each section 12–14 being substantially identical to each other.

A second side section 15 is disposed in parallel relationship relative to first side section 14 and is secured between second ends of the upper and lower sections. The album frame is thus open to display record album 11 and is rectangular in configuration to be substantially coextensive therewith. The sections of the frame may be formed individually out of wood, plastic, metal or other suitable framing material and secured together at their corners by standard miter joints. Alternatively, the frame may be formed as a composite one-piece structure by conventional molding techniques, for example.

As more clearly shown in FIGS. 2–4, elongated grooves 16, 17 and 18 are defined on inner sides of each of the upper, lower and first side sections, respectively. Grooves 16 and 17, defined in each of the upper and lower sections, intersect opposite ends of groove 18 defined in the first side section to further define generally C-shaped composite mounting grooves for retaining three sides of album 11 therein. As more clearly shown in FIG. 4, each individual groove is generally U-shaped to form a channel member which is preferably constructed to provide a slight clearance relative to a respective edge of the album (FIG. 6) to aid in the insertion and removal functions. If so desired, the width of the groove may be constructed to accommodate two albums in back-to-back relationship to expose covers of the albums on both sides of the album frame.

Referring to FIGS. 1 and 3, second side section 15 has an elongated slot 19 formed therethrough to extend substantially the full length thereof. Opposite ends of the slot intersect grooves 16 and 17 of the upper and lower sections of the album frame and has a linear dimension slightly greater than the height of record album 11. Thus, the album may be inserted through slot 19 and slid into the C-shaped composite mounting grooves 16–18 for display purposes.

FIGS. 5 and 6 illustrate a hanger or mounting bracket 20 comprising a first leg 21 disposed in parallel relationship to a second leg 22 and connected together by a bridging portion 23. Leg 21 has a vertical height $h_1$ which is less than vertical height $h_2$ of second leg 22 and which substantially corresponds to the depth of groove 16. In addition, the legs are spaced-apart at a distance $s$ which substantially corresponds to the width of bridging portion 23 and to the thickness of a back rail 24 of upper section 12 which aids in defining groove 16.

A pair of laterally spaced mounting portions 25 and 26 of second leg 22 extend laterally beyond first leg 21 and have holes 27 and 28 formed therethrough, respectively. As shown in FIG. 2, a nail, screw or other suitable fastener 29 may be inserted through each hole to secure the hanger to a wall 30. As further shown, vertical height $h_2$ of second leg 22 is substantially coextensive with the overall height of upper section 12 of the album frame to place it in a hidden and flush position therebehind. If so desired, a semi-frustoconically shaped relief 31 can be formed at the termination of each groove 16 and 17, at respective ends of slot 19, to facilitate insertion of the album, as more clearly shown in FIG. 7.

From the above description, it can be seen that at least one record album 11 may be expeditiously inserted and removed from the album frame which, when inserted therein, is substantially coextensive therewith for retention and protection purposes. Furthermore, the album frame can be expeditiously mounted and demounted on a wall by merely slipping rail 24 of upper section 12 over leg 21 of the hanger. The hanger may be stamped-out of a thin metallic material, such as aluminum, which will not interfere at leg 21 thereof upon insertion and removal of record album 11 from the album frame.

I claim:

1. An open album frame for displaying record albums and the like comprising an upper section, a lower section disposed in parallel relationship relative to said upper section, a first side section secured between first ends of said upper and lower sections, means defining an elongated groove on an inner side of each of said upper, lower and first side sections with the grooves defined in each of said upper and lower sections intersecting opposite ends of the groove defined in said first side section to further define generally C-shaped composite mounting grooves, a second side section disposed in parallel relationship relative to said first side section and secured between second ends of said upper and lower sections to define a rectangular album frame, means defining an elongated slot through said second side section which extends substantially the full length thereof, opposite ends of said slot intersecting the grooves defined in said upper and lower sections whereby an album may be inserted through said slot and slid into the C-shaped composite mounting grooves defined in said frame for display purposes, and a hanger having a pair of first and second parallel legs secured together by a bridging portion, said upper section having a rail partially defining the groove therein and wherein said first leg is disposed in the groove and has a vertical height substantially equal to the depth thereof, said bridging portion is disposed in underlying and supporting relationship relative to said rail and said second leg has a vertical height greater than the vertical height of said first leg and is substantially coextensive with respect to the vertical height of said upper section.

2. The album frame of claim 1 wherein the groove of each of said upper, lower and first side sections is at least generally U-shaped.

3. The album frame of claim 1 wherein each of said upper, lower, first side and second side sections are constructed as an individual channel member with respective corners of said channel members being secured together at miter joints.

4. The album frame of claim 1 wherein said album frame constitutes a one-piece composite structure.

5. The album frame of claim 1 further comprising a record album inserted through said slot and disposed in the grooves defined in said upper, lower and first side sections, said record album being rectangular and substantially coextensive with respect to said album frame.

6. The album frame of claim 5 wherein respective edges of said album are disposed within the grooves defined in said upper, lower and first side sections to provide a slight clearance between said edges and said sections.

7. The album frame of claim 1 wherein the first and second legs of said hanger are spaced apart at a distance substantially equalling the width of the rail of said upper section.

8. The album frame of claim 1 wherein said hanger further comprises a pair of mounting portions formed integrally on either end of said second leg and extending laterally beyond said first leg and a hole formed through each of said mounting portions adapted to receive a fastener therethrough.

9. The album frame of claim 8 further comprising a fastener extending through the hole formed through each of the mounting portions of said hanger, each fastener secured to a wall.

10. The album frame of claim 1 further comprising a relief formed at the termination of the groove defined in each of said upper and lower sections, at respective ends of said slot, to facilitate insertion of an album in said album frame.

11. The album frame of claim 10 wherein each of said reliefs is semi-frustoconically shaped.

* * * * *